US009944484B2

(12) United States Patent
Yamaya

(10) Patent No.: US 9,944,484 B2
(45) Date of Patent: Apr. 17, 2018

(54) TRANSPORT DEVICE AND RECORDING APPARATUS

(71) Applicant: SEIKO EPSON CORPORATION, Tokyo (JP)

(72) Inventor: Keisuke Yamaya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 358 days.

(21) Appl. No.: 14/106,406

(22) Filed: Dec. 13, 2013

(65) Prior Publication Data

US 2014/0166802 A1 Jun. 19, 2014

(30) Foreign Application Priority Data

Dec. 17, 2012 (JP) ..... 2012-275006
Dec. 17, 2012 (JP) ..... 2012-275007

(51) Int. Cl.
*B65H 20/02* (2006.01)

(52) U.S. Cl.
CPC ..... *B65H 20/02* (2013.01); *B65H 2301/4493* (2013.01); *B65H 2404/143* (2013.01); *B65H 2404/1441* (2013.01)

(58) Field of Classification Search
CPC ..... B41J 11/0005; B41J 15/042; B65H 29/12; B65H 2220/02; B65H 20/02; B65H 2301/4493; B65H 2404/143; G03G 15/6576
See application file for complete search history.

(56) References Cited

U.S. PATENT DOCUMENTS 3,568,944 A * 3/1971 Besserdich ..... B65H 18/20 242/541.7
4,077,581 A * 3/1978 Lewis ..... B41J 15/14 242/542.3
4,388,008 A * 6/1983 Greene ..... B41J 13/10 271/9.01
5,060,877 A * 10/1991 Bullivant ..... B65H 16/08 242/564.5
5,098,507 A * 3/1992 Mao ..... B29C 59/04 156/209
5,392,106 A * 2/1995 Bigenwald ..... B65H 29/12 162/270

(Continued)

FOREIGN PATENT DOCUMENTS

CN 101486419 A 7/2009
JP 05-097299 4/1993

(Continued)

*Primary Examiner* — Michael E Gallion
(74) *Attorney, Agent, or Firm* — Workman Nydegger

(57) ABSTRACT

A transport device includes a medium carrying unit on which a medium having a first surface and a second surface opposite the first surface is superposedly wound in a cylindrical shape so as to form a roll body, the second surface being oriented so as to form an inner circumferential surface in the roll body, a route defining portion fixed in a curved shape so as to guide the medium such that the second surface is oriented to the inner side of the curve, and a slave roller that nips the medium in collaboration with a transport roller so as to deform the medium such that the second surface becomes oriented to the outer side of the curve, the slave roller being located downstream of the route defining portion in the transport direction of the medium.

12 Claims, 8 Drawing Sheets

(56) References Cited

U.S. PATENT DOCUMENTS 5,413,426 A * 5/1995 Ijuin ..... B41J 11/0005 346/24
5,450,102 A * 9/1995 Ishida ..... B41J 11/0005 346/136
5,758,840 A * 6/1998 Murakami ..... B65H 23/063 242/415
5,787,331 A * 7/1998 Ohkuma ..... B41J 3/60 162/271
5,855,368 A * 1/1999 Middelberg ..... B65H 5/023 198/588
5,978,645 A * 11/1999 Miyazaki ..... B65H 29/12 399/322
5,979,732 A * 11/1999 Crowley ..... B41J 11/0005 226/111
6,120,199 A * 9/2000 Takekoshi ..... B41J 11/0005 347/102
6,152,619 A * 11/2000 Silverbrook ..... B41J 3/36 347/2
6,247,809 B1 * 6/2001 Kashiwagi ..... B41J 13/223 347/100
6,334,611 B1 * 1/2002 Koo ..... B65H 39/11 270/58.18
6,435,446 B1 * 8/2002 Matsuzawa ..... B65H 16/00 242/422.4
6,474,883 B1 * 11/2002 Kawakami ..... B41J 11/0045 400/611
6,494,631 B1 * 12/2002 Mastinick ..... B41J 33/003 400/206.2
6,811,112 B1 * 11/2004 Currie ..... B65H 54/2872 242/157.1
7,404,683 B2 * 7/2008 Mochizuki ..... B41J 11/0045 400/611
7,553,098 B2 * 6/2009 Maekawa ..... B41J 11/0075 242/563
8,011,844 B2 * 9/2011 Yada ..... B41J 11/0075 242/563
8,177,156 B1 * 5/2012 Rinne ..... A47K 10/34 242/564.4
8,287,198 B2 * 10/2012 Yamagata ..... B41J 11/70 400/664
8,295,758 B2 * 10/2012 Yoshida ..... B65H 5/062 271/270
8,322,644 B2 * 12/2012 Nakada ..... B65H 16/10 242/394.1
8,469,358 B1 * 6/2013 Wen ..... B65H 5/062 271/250
8,752,820 B2 * 6/2014 Nishiyama ..... B41J 13/12 271/2
8,862,047 B2 * 10/2014 Furushige ..... G03G 15/6576 271/188
2002/0043757 A1 * 4/2002 d'Agrella ..... B65H 29/12 271/182
2003/0044208 A1 * 3/2003 Kouno ..... B65H 29/12 399/406
2003/0156881 A1 * 8/2003 Iwata ..... B41J 15/042 400/613
2004/0173706 A1 9/2004 Takagi et al.
2004/0265032 A1 * 12/2004 Furihata ..... B41J 15/042 400/693
2005/0063746 A1 * 3/2005 Sugata ..... B65H 29/12 399/381
2008/0101825 A1 * 5/2008 Sato ..... G03G 15/2053 399/322
2009/0148173 A1 * 6/2009 Tajima ..... G03G 15/0258 399/36
2009/0190984 A1 * 7/2009 Yamamoto ..... B41J 11/0005 399/406
2009/0190985 A1 * 7/2009 Yamamoto ..... B41J 11/0005 399/406
2009/0278307 A1 * 11/2009 Skinner ..... B65H 3/0638 271/273
2011/0216140 A1 * 9/2011 Yamaya ..... B41J 2/01 347/104
2011/0234731 A1 * 9/2011 Fujimaki ..... B41J 15/042 347/104
2011/0236102 A1 * 9/2011 Furushige ..... G03G 15/6576 399/406
2012/0153565 A1 * 6/2012 Deno ..... B65H 5/38 271/226
2013/0045019 A1 * 2/2013 Matsuzuki ..... G03G 15/201 399/67
2014/0061998 A1 * 3/2014 Kasashima ..... B65H 5/06 271/10.11
2014/0147186 A1 * 5/2014 Uchino ..... B41J 11/42 400/613
2014/0166802 A1 * 6/2014 Yamaya ..... B65H 20/02 242/564.4
2014/0186086 A1 * 7/2014 Yato ..... B41J 15/042 400/611
2014/0284869 A1 * 9/2014 Takamori ..... B65H 5/062 271/109
2015/0001790 A1 * 1/2015 Lo ..... B65H 7/20 271/209
2016/0039229 A1 * 2/2016 Zhang ..... B41J 15/005 347/110

FOREIGN PATENT DOCUMENTS

| | | |
|---|---|---|
| JP | 08-282900 | 10/1996 |
| JP | 09-263348 | 10/1997 |
| JP | 11-078146 | 3/1999 |
| JP | 2000-034048 | 2/2000 |
| JP | 2003-182172 | 7/2003 |
| JP | 2004-268269 | 9/2004 |
| JP | 2007-112546 | 5/2007 |
| JP | 2009-179416 | 8/2009 |
| JP | 2012-162367 | 8/2012 |

* cited by examiner

TRANSPORT DEVICE AND RECORDING APPARATUS

BACKGROUND

1. Technical Field

The present invention relates to a transport device capable of correcting winding curl of a medium such as a paper sheet and a recording apparatus incorporated with the transport device, and to a transport device including a pair of transport rollers that transports the medium and a recording apparatus incorporated with the transport device.

2. Related Art

Recording apparatuses thus far developed include a printer having a pair of transport rollers that transport in a horizontal direction a continuous paper sheet wound off from a state wound in a roll shape, and a decurl roller that nips the paper sheet in collaboration with the downstream one of the pair of transport rollers in the direction in which the sheet is transported (hereinafter, transport direction). The decurl roller serves to bend the paper sheet supported by the pair of transport rollers in a direction opposite to the direction of the curl originating from the winding, to thereby correct such winding curl of the paper sheet, for example as disclosed in JP-A-2012-162367. The cited document also discloses a printer including the transport roller and the decurl roller that nips and bends the paper sheet in collaboration with the transport roller to thereby correct the winding curl of the paper sheet, the transport roller and the decurl roller being mounted in the transport route along which the continuous paper sheet wound off from the roll is transported.

The pair of transport rollers are configured to transport the paper sheet curled by winding in the horizontal direction, and hence the surface of the paper sheet curled in a concave shape may float from the transport roller, and the position to support the paper sheet to be bent may be shifted. When the position to support the paper sheet is shifted, the paper sheet is unable to be sufficiently bent in the direction opposite to the curling direction, and the winding curl is unable to be effectively corrected.

Such a drawback is commonly seen in transport devices that transport a medium curled by winding and recording apparatuses including such a transport device in general, not only in the transport device that transports the paper sheet and the printer that performs recording on the paper sheet.

In addition, in the case of transporting the paper sheet curled by winding or bending the paper sheet in the transport route, the curled paper sheet may be caught by a component constituting the transport route thereby causing a paper jam. Since the paper sheet is nipped between the transport roller and the decurl roller, the paper sheet may be torn upon being pulled so as to remove the paper jam, and a piece of the paper sheet torn away may remain on the transport route. Thus, it is difficult to perform the maintenance work for removing the paper jam, for the transport route configured as above.

Again, the mentioned drawback is commonly seen in transport devices that include a pair of transport rollers configured to nip a medium therebetween and recording apparatuses including such a transport device in general, not only in the transport device that transports the paper sheet and the printer that performs recording on the paper sheet.

SUMMARY

An advantage of some aspects of the invention is provision of at least one of a transport device configured to effectively correct winding curl of a medium, a transport device configured to facilitate maintenance work for a portion of a transport route in the vicinity of a pair of transport rollers, a recording apparatus configured to effectively correct winding curl of a medium, and a recording apparatus configured to facilitate maintenance work for a portion of a transport route in the vicinity of a transport roller.

In an aspect, the invention provides a transport device including a medium carrying unit on which a medium having a first surface and a second surface opposite the first surface is superposedly wound in a cylindrical shape so as to form a roll body, the second surface being oriented so as to form an inner circumferential surface in the roll body, a route defining portion fixed in a curved shape so as to guide the medium such that the second surface is oriented to the inner side of the curve, and a second roller that nips the medium in collaboration with a first roller so as to deform the medium such that the second surface becomes oriented to the outer side of the curve, the second roller being located downstream of the route defining portion in the direction in which the medium is transported.

Since the medium is superposedly wound such that the second surface corresponds to the inner circumferential surface, the medium wound off from the roll body is curled by winding, such that the second surface corresponds to the inner side of the curl. With the mentioned configuration, however, the curved route defining portion serves to guide the medium such that the second surface thereof remains oriented to the inner side of the curl of the medium, and therefore the winding curl of the medium can be corrected upon nipping the medium between the second roller and the first roller so as to deform the medium so as to orient the second surface thereof to the outer side of the curl. In addition, since the route defining portion is curved in the direction aligned with the winding curl of the medium, fluctuation of the position to support the medium is suppressed. Therefore, the winding curl of the medium can be effectively corrected.

In another aspect, the invention provides a recording apparatus including the foregoing transport device and a recording unit that performs recording on the medium transported by the transport device. The first roller and the second roller are located upstream of the recording unit in the transport direction.

With the mentioned configuration, the first roller and the second roller correct the winding curl of the medium at a position upstream of the recording unit in the transport direction. Therefore, the medium can be prevented from floating at a position close to the recording unit.

Preferably, the recording apparatus may further include a plurality of pairs of transport rollers that transport the medium toward the recording unit, and the first roller and the second roller may be located at a most upstream position in the transport direction, among the plurality of pairs of transport rollers.

With the mentioned configuration, the second roller corrects the winding curl of the medium at the position most upstream in the transport direction in the transport route provided from the medium carrying unit toward the recording unit. Therefore, disturbance to the transport of the medium originating from the curl thereof can be prevented at a downstream position on the transport route.

In the foregoing recording apparatus, preferably, the route defining portion may have a smaller curvature radius than the inner circumferential surface of the roll body.

In this case, since the route defining portion of the curved shape has a smaller curvature radius than the inner circumferential surface of the roll body, the winding curl of the medium can be surely corrected without incurring an increase in size of the apparatus.

In the foregoing recording apparatus, preferably, the outer circumferential surface of the first roller may have a smaller curvature radius than the inner circumferential surface of the roll body, and the second roller may nip the medium in collaboration with the first roller, in contact with the first surface of the medium in a valley portion formed between the route defining portion and the first roller.

In this case, since the outer circumferential surface of the first roller has a smaller curvature radius than the inner circumferential surface of the roll body, the winding curl of the medium can be surely corrected without incurring an increase in size of the apparatus. In addition, since the second roller is in contact with the first surface of the medium in the valley portion, the medium can be bent along the valley portion while the medium is securely supported by the route defining portion and the first roller.

In the foregoing recording apparatus, preferably, the first roller may serve as a transport roller to be made to rotate in a first direction so as to transport the medium in the transport direction and to rotate in a second direction opposite to the first direction so as to transport the medium back toward the medium carrying unit, and the second roller may serve as a slave roller to be set to an engaging position to nip the medium in collaboration with the first roller when the first roller is made to rotate in the first direction and to be displaced to a retracted position spaced from the engaging position when the first roller is made to rotate in the second direction.

In this case, the first roller is made to rotate in the first direction when the second roller nips the medium in collaboration with the first roller. Such a configuration allows the winding curl of the medium to be corrected while transporting the medium. In contrast, since the second roller is displaced to the retracted position when the first roller is made to rotate in the second direction, the backward movement of the medium is prevented from being disturbed.

Preferably, the recording apparatus may further include a drive source that rotates the first roller, a moving mechanism that displaces the second roller from the retracted position to the engaging position with the driving force of the drive source, and a restriction mechanism that restricts transmission of the driving force to the moving mechanism when pressing force of the second roller placed at the engaging position against the first roller exceeds a predetermined threshold.

Such a configuration eliminates the need to separately provide a drive source for moving the second roller, because the second roller is displaced by the driving force of the drive source utilized to rotate the first roller.

Further, in the case where the pressing force of the second roller set to the engaging position exerted on the first roller exceeds the predetermined threshold, the restriction mechanism restricts the transmission of the driving force to the moving mechanism. Such an arrangement prevents an excessive increase of the nip pressure of the pair of transport rollers against the medium. Therefore, the winding curl of the medium can be corrected without disturbing the transport of the medium.

In still another aspect, the invention provides a transport device including a medium guide member that forms part of a transport route of a medium, a pair of transport rollers configured to rotate with the medium nipped therebetween to transport the medium along the transport route, and a retention frame that supports the medium guide member and the pair of transport rollers. The retention frame is installed in a casing, the retention frame being set to be drawn out therefrom, and the pair of transport rollers release the medium from the nipped state when the retention frame is drawn out from the casing.

With the mentioned configuration, the pair of transport rollers release the medium from the nipped state when the retention frame is drawn out from the casing for example when the medium is jammed on the transport route, and hence the medium can be easily removed. Such a configuration facilitates the maintenance work for the transport route in the vicinity of the pair of transport rollers.

Preferably, the transport device may further include an engaging portion located inside the casing and a release mechanism retained by the retention frame, and the pair of transport rollers may release the medium when the release mechanism is engaged with the engaging portion because of the retention frame being drawn out from the casing.

In this case, since the engaging portion and the release mechanism are engaged with each other when the retention frame is drawn out from the casing, there is no need to take an additional step to release the medium from the pair of transport rollers.

Preferably, the transport device may further include a drive source located inside the casing and a transmission mechanism that transmits the driving force of the drive source to the pair of transport rollers, and the transmission mechanism may be disengaged from the drive source when the retention frame is drawn out from the casing.

In this case, the transmission mechanism is disengaged from the drive source when the retention frame is drawn out from the casing, and hence the transport roller is set to freely rotate. Such a configuration reduces frictional resistance arising between the medium and the transport roller when the medium is removed from the transport route.

In the foregoing transport device, preferably, the retention frame may rotatably support a roll body formed by superposingly winding the medium in a cylindrical shape, and the pair of transport rollers may bend the medium on the transport route so as to correct winding curl of the medium.

With the mentioned configuration, the winding curl of the medium can be corrected with the pair of transport rollers. In addition, even when the medium is a continuous sheet formed in a roll body, the medium can be easily removed from the transport route because the pair of transport rollers release the medium from the nipped state.

Preferably, the transport device may further include a rack fixed to the casing and a pinion supported by the retention frame, and the pair of transport rollers may release the medium from the nipped state when the pinion meshed with the rack is made to rotate because of the retention frame being drawn out.

Such a configuration allows the pair of transport rollers to release the medium from the nipped state by using the rack and pinion mechanism.

Preferably, the transport device may further include a rack fixed to the casing, a pinion supported by the retention frame, a drive shaft to be made to rotate with driving force of a drive source, a movable shaft set to relatively move with respect to the drive shaft, and a moving mechanism that relatively moves the movable shaft with respect to the drive shaft when the drive shaft is made to rotate. The pair of transport rollers may include a first roller supported by the drive shaft so as to rotate interlocked therewith and a second roller rotatably supported by the movable shaft. The drive shaft may be made to rotate in a first direction by rotation of the pinion so as to cause the moving mechanism to displace the movable shaft toward the drive shaft, the pinion being meshed with the rack so as to rotate when the retention frame is moved back into the casing; the drive shaft may be made to rotate in a second direction by rotation of the pinion so as to cause the moving mechanism to displace the movable shaft away from the drive shaft, the pinion being meshed with the rack so as to rotate when the retention frame is drawn out from the casing; and the pinion may be disengaged from the rack when the retention frame is completely set inside the casing.

With the mentioned configuration, the pair of transport rollers release the medium from the nipped state when the movable shaft is displaced away from the drive shaft because of the retention frame being drawn out from the casing. In contrast, the second roller is moved to the position to nip the medium when the movable shaft is displaced toward the drive shaft because of the retention frame being moved back into the casing. Such a configuration eliminates the need to take an additional step to displace the second roller after the retention frame is set back in the casing upon finishing the maintenance work of the transport route. Further, since the pinion is disengaged from the rack when the retention frame is completely set back in the casing, the retention frame is kept from moving despite the drive shaft being made to rotate by the driving force of the drive source to transport the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, a recording apparatus according to an embodiment of the invention will be described with reference to the drawings.

Figure 1:
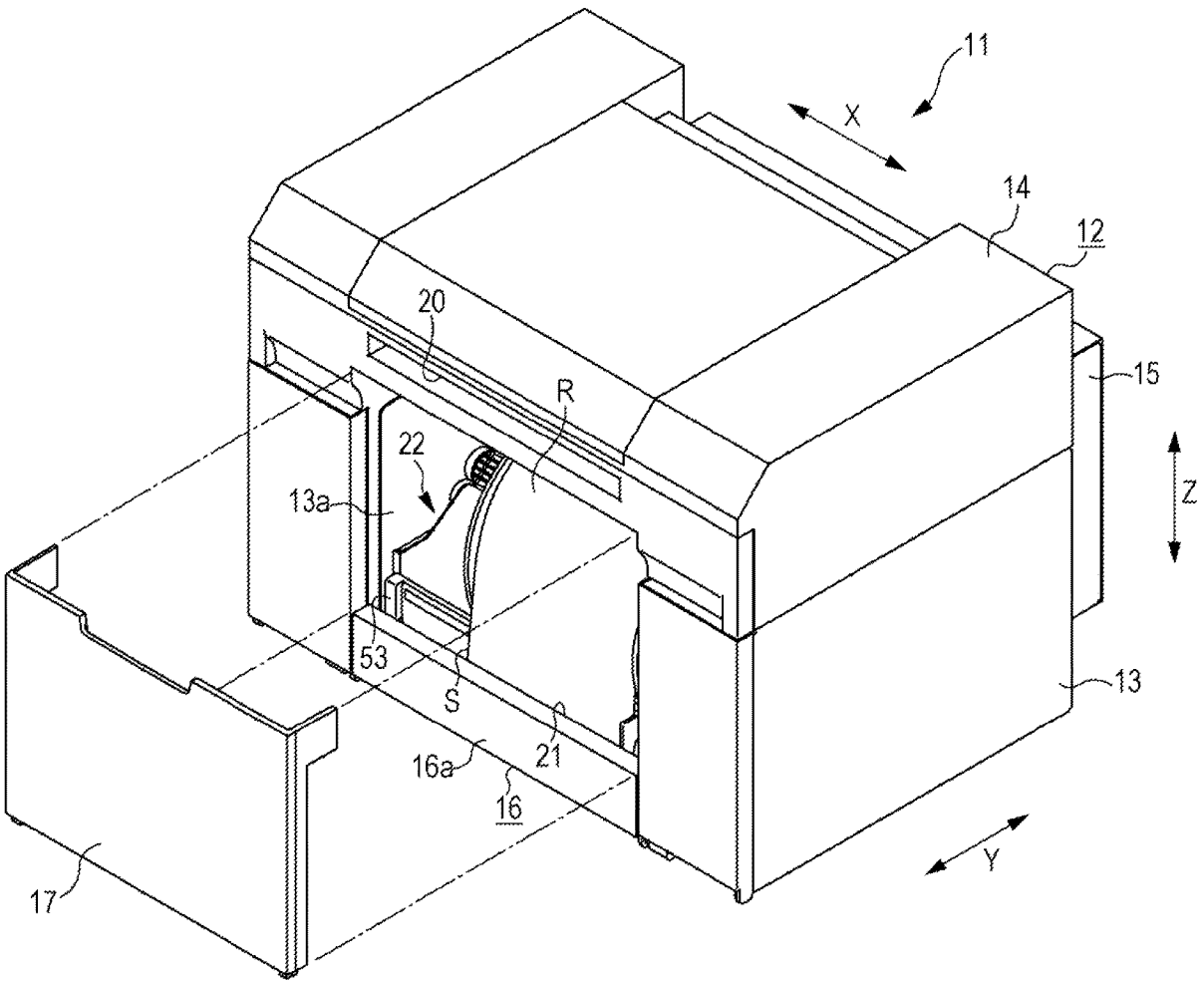
FIG. 1 is a perspective view showing a recording apparatus according to an embodiment of the invention.

As shown in FIG. 1, the recording apparatus 11 according to this embodiment includes a casing 12 of a generally rectangular box shape. The casing 12 includes a first block 13, a second block 14 superposed on the first block 13, and a third block 15 located at the back of the first block 13. In this embodiment, the direction in which the second block 14 and the third block 15 are aligned, intersecting an up-down direction Z (orthogonal in this embodiment), will be defined as front-back direction Y. In addition, the longitudinal direction of the first block 13 and the second block 14, intersecting the up-down direction Z and the front-back direction Y (orthogonal in this embodiment), will be defined as width direction X.

The first block 13 of the casing 12 includes a chamber 13*a* formed close to the central portion in the width direction X. A retention frame 16 is placed inside the chamber 13*a*, the retention frame 16 being set to be drawn out therefrom. When the retention frame 16 is set inside the casing 12 as shown in FIG. 1, a front plate 16*a* of the retention frame 16 is exposed on the front face of the first block 13. The retention frame 16 includes an insertion slot 21 located at the back of the front plate 16*a*, through which a paper sheet S, exemplifying the medium, is introduced.

The first block 13 includes a front cover 17 removably attached on top of the front plate 16*a*. The second block 14 includes a sheet outlet 20 provided on the front face thereof, at a position above the chamber 13*a*.

Figure 2:
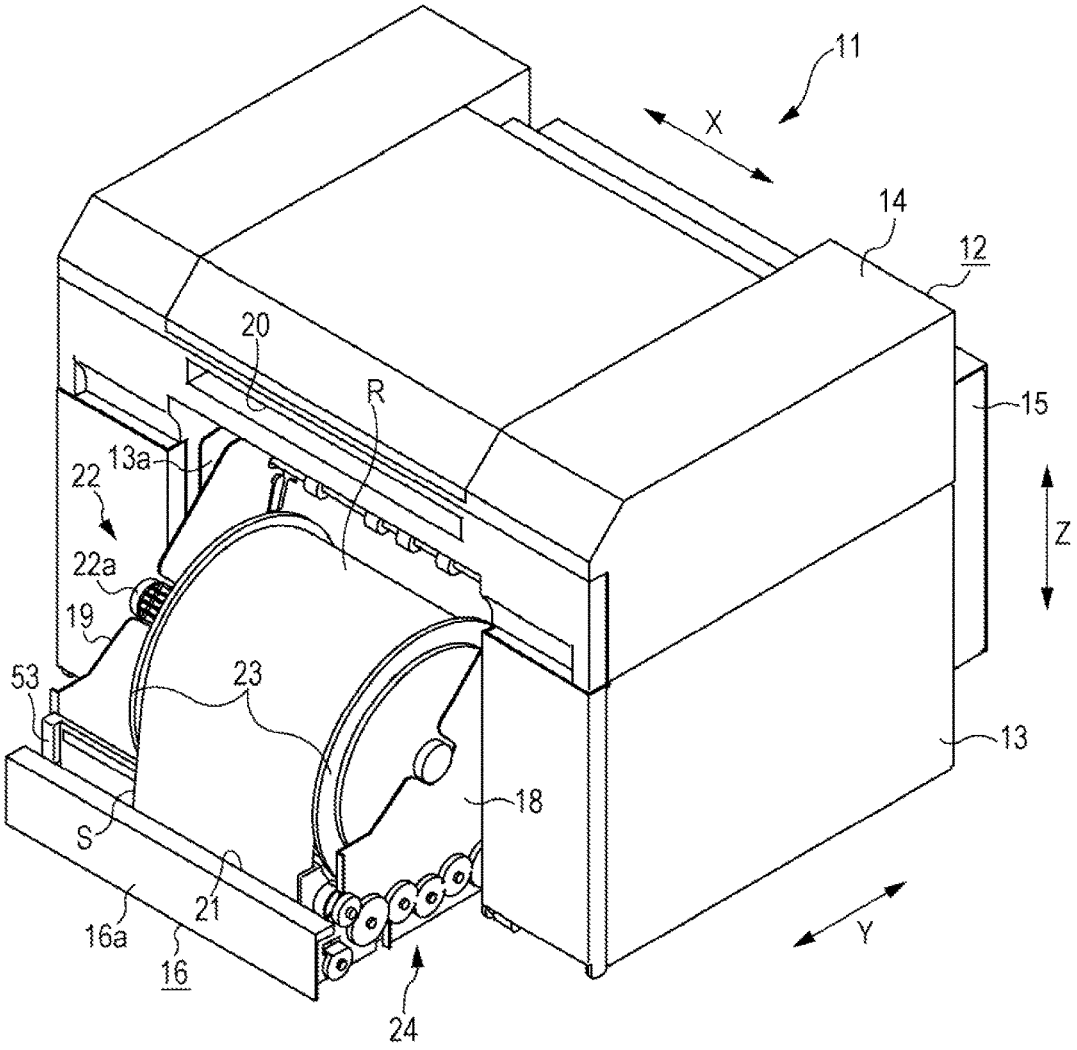
FIG. 2 is a perspective view showing the recording apparatus with a retention frame drawn out.

Referring to FIG. 2, the retention frame 16 includes a pair of side walls 18, 19 provided on the respective end portions in the width direction X. The side wall 18 on a first end portion in the width direction X (on the right in FIG. 2) serves to support components of a transport device 24. The front plate 16*a* is fixed to the respective front end portions of the side walls 18, 19.

The retention frame 16 also supports a medium carrying unit 22 on which the paper sheet S is superposedly wound in a cylindrical shape so as to form a roll body R. The medium carrying unit 22 includes a support shaft 22*a* passed through the inner diameter portion of the roll body R and a pair of flange portions 23. The support shaft 22*a* is rotatably supported by the side walls 18, 19. Thus, the retention frame 16 rotatably supports the support shaft 22*a* that supports the roll body R formed by superposingly winding the paper sheet S in a cylindrical shape.

To mount the roll body R on the medium carrying unit 22, the retention frame 16 is drawn out forward from the chamber 13*a*. Then after setting the roll body R on the medium carrying unit 22 with the retention frame 16 drawn out as shown in FIG. 2, the leading edge of the paper sheet S wound off from the roll body R is manually introduced into the insertion slot 21.

Figure 3:
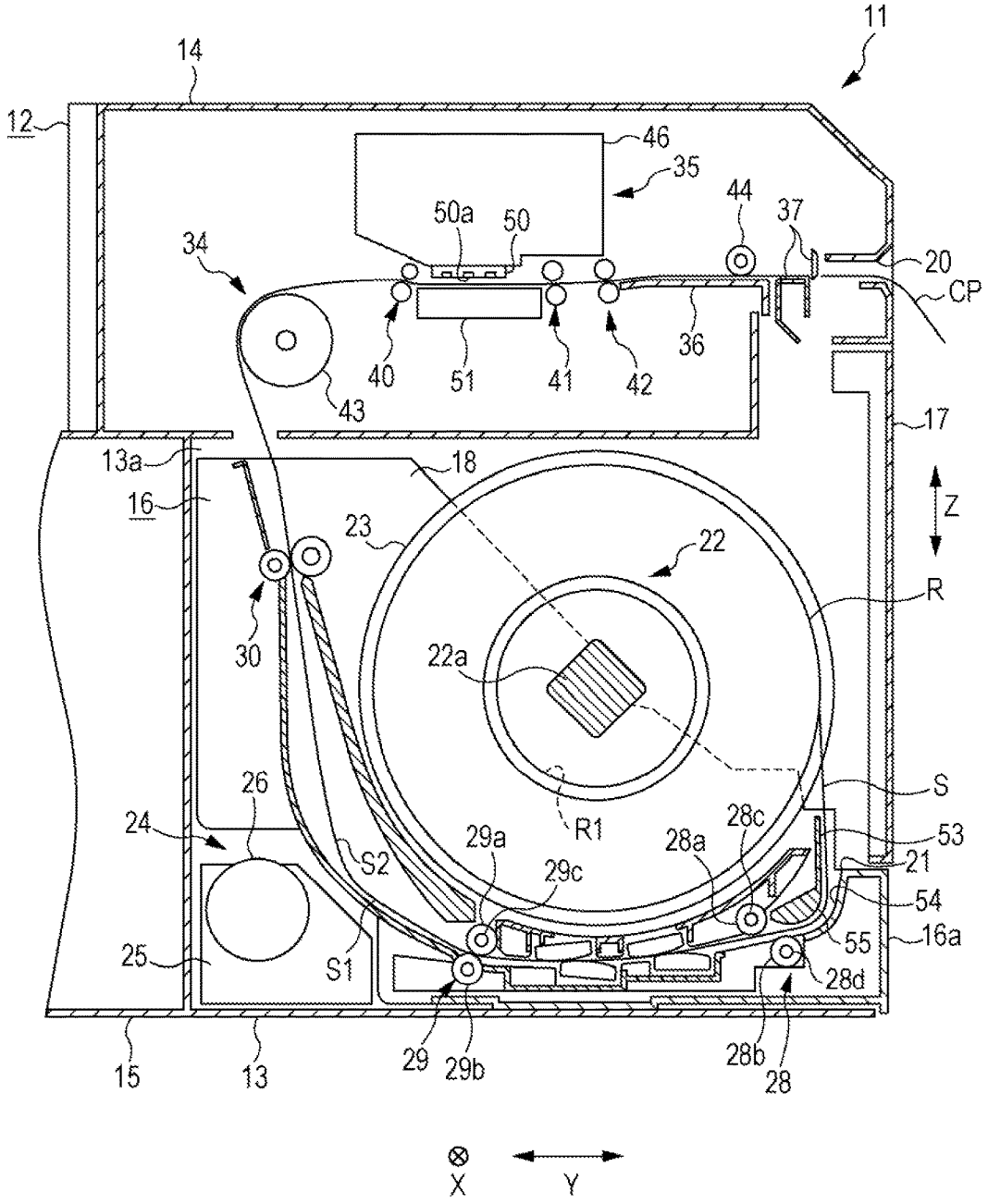
FIG. 3 is a cross-sectional view showing a general configuration of the recording apparatus.

FIG. 3 is a cross-sectional view of the casing 12 seen from the left.

As shown in FIG. 3, a fixed frame 25 is provided on the bottom of the chamber 13*a* and behind the retention frame 16. On the first end portion of the fixed frame 25 and the retention frame 16 in the width direction X, the transport device 24 that transports the paper sheet S toward the second block 14 is provided. In the description given hereunder, the direction in which the paper sheet S wound off from the medium carrying unit 22 advances toward the second block 14 will be referred to as transport direction of the paper sheet S. The transport device 24 serves to transport the paper sheet S in the transport direction, along a transport route formed in the retention frame 16.

The second block 14 includes therein a transport mechanism 34 configured to transport the paper sheet S toward the sheet outlet 20, a recording unit 35 that performs recording on the paper sheet S transported by the transport device 24 and the transport mechanism 34, a heater 36 that dries the paper sheet S on which ink is applied, and a cutter 37 that cuts the paper sheet S.

The transport mechanism 34 includes pairs of transport rollers 30, 40, 41, 42, an intermediate roller 43, and a discharge roller 44. The pair of transport rollers 30 are supported by the retention frame 16. Here, the transport mechanism 34 may be construed as part of the transport device 24.

The recording unit 35 includes a carriage 46 set to reciprocate in the width direction X, and a liquid ejecting unit 50 located in the lower portion of the carriage 46. A plurality of liquid ejecting nozzles 50*a* through which ink, an example of the liquid, is ejected are provided on the lower face of the liquid ejecting unit 50. In addition, a support member 51 that supports the paper sheet S is provided below the carriage 46, at a position between the pair of transport rollers 40 and the pair of transport rollers 41 located along the transport route.

A predetermined region on the support member 51 is utilized as a printing region. The transport mechanism 34 intermittently transports the paper sheet S in increments corresponding to the printing region. Then the liquid ejecting unit 50 ejects the ink onto the paper sheet S stopped on the support member 51, while moving in the width direction X together with the carriage 46, thereby performing a printing operation. The paper sheet S that has undergone the printing operation by the recording unit 35 is transported along the upper face of the heater 36 of a plate shape, thus to be dried.

The paper sheet S that has passed over the heater 36 and been dried is cut by the cutter 37 into a predetermined unit length, and thus turns into a cut sheet CP. The cut sheet CP is then discharged out of the casing 12 through the sheet outlet 20.

The paper sheet S has a first surface S1 onto which the ink is ejected, and a second surface S2 opposite to the first surface S1. The paper sheet S is superposedly wound in a cylindrical shape such that the second surface S2 is oriented toward the axial center, so as to form the roll body R in which the second surface S2 constitutes an inner circumferential surface R1. Accordingly, the paper sheet S wound off from the roll body R is curled because of the winding, such that the first surface S1 assumes a convex shape and the second surface S2 assumes a concave shape.

A configuration of the transport device 24 will now be described hereunder.

The retention frame 16 supports a medium guide member 53 that defines the insertion slot 21 with the front plate 16*a*. The medium guide member 53 includes a route defining portion 55 curved in a convex shape that guides the paper sheet S wound off from the roll body R such that the second surface S2 is oriented to the inner side of the curve. In addition, the front plate 16*a* includes a route defining portion 54 of a curved shape that guides the first surface S1 of the paper sheet S. The route defining portions 54, 55 have a smaller curvature radius than the inner circumferential surface R1 of the roll body R, and are fixed at a position downstream of the medium carrying unit 22 in the transport direction.

The retention frame 16 supports pairs of transport rollers 28, 29. In addition, a drive source 26 mounted on the fixed frame 25 is provided inside the casing 12. The drive source 26 may be, for example, a motor that rotates in a first direction and a second direction opposite to the first direction.

The pair of transport rollers 28 located at a most upstream position in the transport direction includes a transport roller 28*a* exemplifying the first roller in the invention, and a slave roller 28*b* exemplifying the second roller in the invention. The transport roller 28*a* is located downstream of the route defining portion 55 in the transport direction of the paper sheet S, and at a position where the transport roller 28*a* can make contact with the second surface S2 of the paper sheet S. In contrast, the slave roller 28*b* is located downstream of the route defining portion 54 in the transport direction of the paper sheet S, and at a position where the slave roller 28*b* can make contact with the first surface S1 of the paper sheet S. The respective outer circumferential surfaces of the transport roller 28*a* and the slave roller 28*b* have a smaller curvature radius than the inner circumferential surface R1 of the roll body R and the route defining portions 54, 55.

The transport roller 28*a* is supported by a drive shaft 28*c* so as to rotate interlocked therewith, the drive shaft 28*c* being set to be driven by the driving force of the drive source 26. In contrast, the slave roller 28*b* is rotatably supported by a movable shaft 28*d* that can be relatively displaced with respect to the drive shaft 28*c*. The pair of transport rollers 28 transport the paper sheet S along the transport route, when the transport roller 28*a* is driven to rotate with the paper sheet S nipped between the transport roller 28*a* and the slave roller 28*b*.

The pair of transport rollers 29 located downstream of the pair of transport rollers 28 in the transport direction include a transport roller 29*a* and a slave roller 29*b*. The transport roller 29*a* is supported by a drive shaft 29*c* so as to rotate interlocked therewith, the drive shaft 29*c* being set to be driven by the driving force of the drive source 26.

Figure 4:
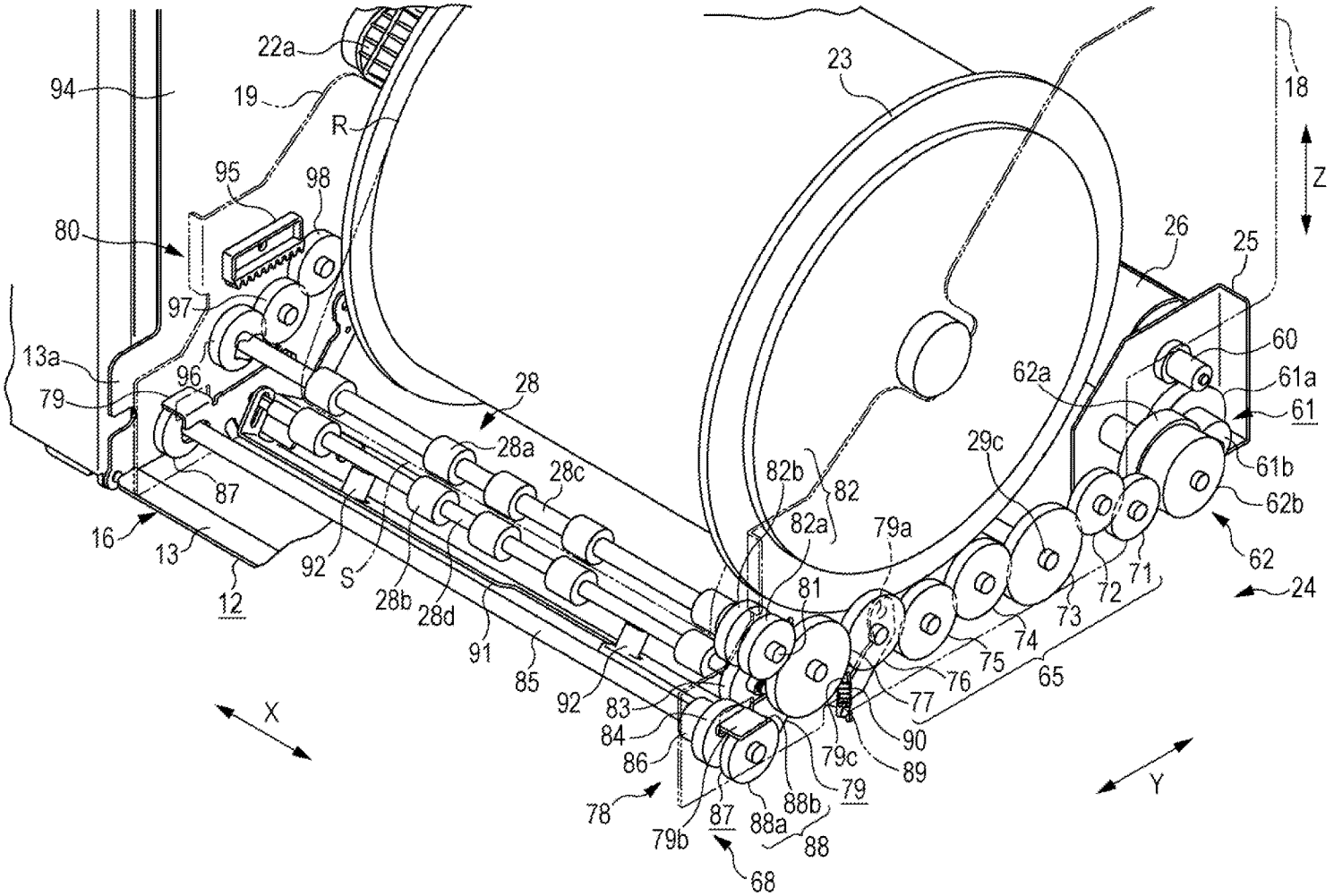
FIG. 4 is a perspective view showing a configuration of a transport device.

FIG. 4 is a perspective view of the retention frame 16 set inside the chamber 13*a*, obliquely seen from the right. Here, for the sake of clarity of the description of the transport device 24, the front plate 16*a* of the retention frame 16 and the medium guide member 53 are excluded from FIG. 4, and the side walls 18, 19 are drawn in imaginary lines in FIG. 4.

As shown in FIG. 4, the fixed frame 25 rotatably supports a motor pinion 60 driven to rotate by the drive source 26, a first composite gear 61, and a second composite gear 62. In addition, a gear row 78 and a transmission mechanism 65 that transmits the driving force of the drive source 26 to the pair of transport rollers 28 are provided on the side wall 18 of the retention frame 16.

A larger diameter gear 61*a* included in the first composite gear 61 is meshed with the motor pinion 60. The smaller diameter gear 61*b*, also included in the first composite gear 61, is meshed with a larger diameter gear 62*a* included in the second composite gear 62.

The transmission mechanism 65 provided on the side wall 18 includes a first gear 71 meshed with a smaller diameter gear 62*b* included in the second composite gear 62, a second gear 72 meshed with the first gear 71, and a third gear 73 meshed with the second gear 72. The third gear 73 is attached to an end portion of the drive shaft 29*c*. The transmission mechanism 65 further includes a fourth gear 74 meshed with the third gear 73, a fifth gear 75 meshed with the fourth gear 74, a sixth gear 76 meshed with the fifth gear 75, and a seventh gear 77 meshed with the sixth gear 76. The seventh gear 77 is attached to an end portion of the drive shaft 28*c*.

The gear row 78 includes two spur gears 82 (82*a*, 82*b*) attached to a gear shaft 81 so as to rotate interlocked therewith, the gear shaft 81 being located obliquely above the seventh gear 77. A first spur gear 82*a* of the two spur gears 82, located on the outer side of the side wall 18, is meshed with the seventh gear 77. The gear row 78 also includes a third spur gear 83 meshed with the second spur gear 82*b* on the inner side of the side wall 18, and a fourth spur gear 84 meshed with the third spur gear 83. The fourth spur gear 84 is attached to a rotary shaft 85 so as to rotate interlocked therewith, the rotary shaft 85 being located obliquely below the movable shaft 28*d*.

A restriction mechanism 86 is provided between the fourth spur gear 84 and the rotary shaft 85. The restriction mechanism 86 may be, for example, a torque limiter that restricts transmission of the rotational force (torque) for driving the rotary shaft 85 from the fourth spur gear 84 to the rotary shaft 85, when the rotational force exceeds a predetermined threshold. In other words, the restriction mechanism 86 does not restrict the transmission of the rotational force for driving the rotary shaft 85 from the fourth spur gear 84 to the rotary shaft 85, while the rotational force is below the predetermined threshold. When the restriction mechanism 86 restricts the transmission of the rotational force, the fourth spur gear 84 is made to slide with respect to the rotary shaft 85 with a certain load imposed thereon, and thus the rotational force exceeding the threshold is not applied to the rotary shaft 85.

Hereunder, description will be given about a configuration of the moving mechanism 68 that serves to correct the winding curl of the paper sheet S.

The side walls 18, 19 supports the moving mechanism 68 that relatively displaces the movable shaft 28*d* with respect to the drive shaft 28*c*. The moving mechanism 68 includes a pair of pivotal levers 79 rotatably supported by the side walls 18, 19, a pair of rotating cams 87 attached to the respective end portions of the rotary shaft 85, a pressing member 91 supported by the pivotal lever 79, and a pair of tensile springs 90 of a coil shape. The pressing member 91 includes a pair of pressing projections 92 configured to press the movable shaft 28*d* toward the drive shaft 28*c*.

The rotating cam 87 includes a cam surface 88 composed of a curved cam surface 88*a* and a flat cam surface 88*b* continuously formed in the circumferential direction. The flat cam surface 88*b* is radially closer to the rotary shaft 85 than the curved cam surface 88*a*.

The pivotal lever 79 includes a rotary shaft 79*a* located in the base portion, corresponding to the rear end portion in this embodiment, and an engaging plate 79*b* provided on the distal end portion corresponding to the front end portion in this embodiment. The engaging plate 79*b* of the pivotal lever 79 sticks out toward the outer side of the side wall 18 and is located on top of the rotating cam 87. The pivotal lever 79 also includes a spring connector 79*c* between the rotary shaft 79*a* and the engaging plate 79*b* in the longitudinal direction corresponding to the front-back direction Y.

The side walls 18, 19 of the retention frame 16 each include a spring connecting projection 89 located below the spring connector 79*c* of the pivotal lever 79. The end portions of the tensile spring 90 are respectively connected to the spring connector 79*c* and the spring connecting projection 89. The tensile spring 90 exerts a downward biasing force on the distal end portion of the pivotal lever 79, so that the engaging plate 79*b* is made to abut the cam surface 88 of the rotating cam 87. While the drive source 26 is off, the engaging plate 79*b* is in contact with the flat cam surface 88*b*. In this state, the slave roller 28*b* is set to the retracted position spaced from the transport roller 28*a*, as shown in FIG. 4.

A configuration of a release mechanism 80 that disengages the pair of transport rollers 28 from the paper sheet S will now be described hereunder.

The release mechanism 80 is provided on the side wall 19 of the retention frame 16. In the casing 12, a rack 95 exemplifying the engaging portion in the invention is fixed to an inner wall 94 constituting part of the chamber 13*a*, the rack 95 being configured to be engaged with the release mechanism 80 when the retention frame 16 is drawn out. When the release mechanism 80 supported by the retention frame 16 is engaged with the rack 95 because of the retention frame 16 being drawn out from the casing 12, the pair of transport rollers 28 release the paper sheet S from the nipped state.

The release mechanism 80 includes a gear 96 attached to a second end portion (on the left in FIG. 4) of the drive shaft 28*c* in the width direction X, a transmission gear 97 meshed with the gear 96, and a pinion 98 meshed with the transmission gear 97. The pinion 98 is located so as to be meshed with the rack 95 upon being displaced in the front-back direction Y.

Hereunder, the working of the transport device 24 will be described, focusing on the winding curl correction function of the moving mechanism 68 with respect to the paper sheet S. Here, FIG. 5 is a cross-sectional view of the transport device 24 seen from the right, in which the retention frame 16 is set inside the casing 12.

Figure 5:
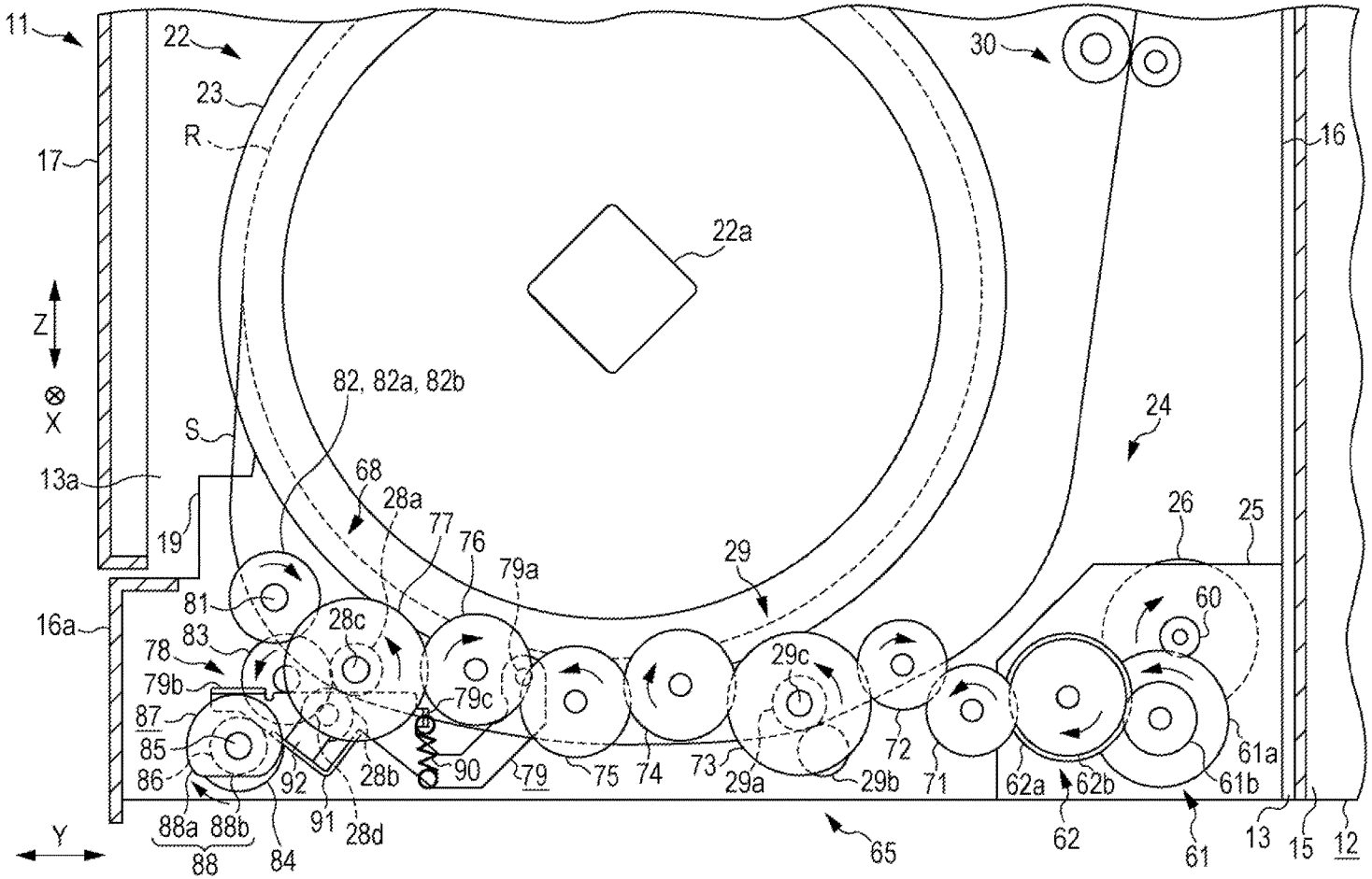
FIG. 5 is a cross-sectional view for explaining a function of the transport device.

As shown in FIG. 5, in order to transport the paper sheet S in the transport direction the drive source 26 rotates in the first direction, so that the gears 71 to 77 constituting the motor pinion 60, the first composite gear 61, the second composite gear 62, and the transmission mechanism 65 are made to rotate in the forward direction indicated by arrows in FIG. 5. Accordingly, the transport roller 28*a* supported by the drive shaft 28*c* and the transport roller 29*a* supported by the drive shaft 29*c* are made to rotate in the first direction (counterclockwise in FIG. 5).

With the rotation of the seventh gear 77, the spur gears 82 to 84 constituting the gear row 78 and the rotary shaft 85 are made to rotate in the forward direction indicated by arrows in FIG. 5. Further, the rotating cam 87 is made to rotate clockwise in FIG. 5 so as to lift up the engaging plate 79*b* via the curved cam surface 88*a*. Then the pivotal lever 79 is made to pivot clockwise against the biasing force of the tensile spring 90.

Accordingly, the pressing member 91 is displaced upward, so that the pressing projection 92 presses the movable shaft 28*d* toward the drive shaft 28*c*. As a result, the slave roller 28*b* is set to the engaging position to nip the paper sheet S in collaboration with the transport roller 28*a*. Thus, the moving mechanism 68 serves to displace the slave roller 28*b* from the retracted position to the engaging position, with the driving force of the drive source 26.

In the case where the pressing force of the slave roller 28*b* set to the engaging position exerted on the transport roller 28*a* exceeds the predetermined threshold, the restriction mechanism 86 restricts the transmission of the rotational force from the fourth spur gear 84 to the rotary shaft 85, thus to restrict the transmission of the driving force to the moving mechanism 68. Therefore, when the pressure to the paper sheet S nipped between the slave roller 28*b* and the transport roller 28*a* reaches the predetermined threshold, the slave roller 28*b* is restricted from moving further toward the transport roller 28*a*.

Figure 6:
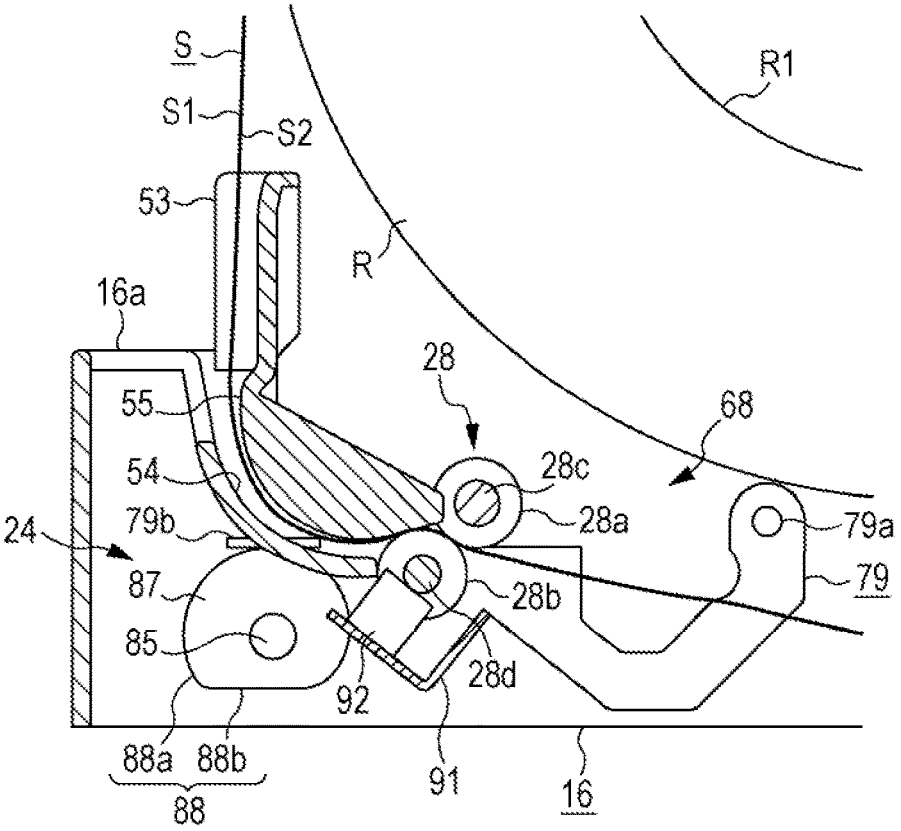
FIG. 6 is a cross-sectional view for explaining a function of a moving mechanism.

Referring now to FIG. 6, the route defining portion 55 curved in a convex shape is provided upstream of the transport roller 28*a* in the transport direction, the transport roller 28*a* being engaged with the paper sheet S. In addition, the route defining portion 54 curved in a concave shape is provided upstream of the slave roller 28*b* in the transport direction.

The route defining portions 54, 55 have a smaller curvature radius than the inner circumferential surface R1 of the roll body R, and are fixed at positions downstream of the medium carrying unit 22 in the transport direction. In other words, the route defining portions 54, 55 constitute a transport route curved so as to increase the curvature of the paper sheet S curled by winding.

Accordingly, the paper sheet S passing through the transport route is guided by the route defining portion 54, 55 so as to be further curled in a larger curvature than the winding curl. In addition, the slave roller 28*b* displaced to the engaging position nips the paper sheet S in contact with the first surface S1 thereof in collaboration with the transport roller 28*a*, in a valley portion formed in a recessed shape between the curved route defining portion 55 and the outer circumferential surface of the transport roller 28*a*.

Then the portion of the paper sheet S engaged with the route defining portion 55 and the transport roller 28*a* is made to curl along the valley portion in a curling direction opposite to the winding curl. Thus, the slave roller 28*b* serves to deform the first surface S1 given the convex shape by the winding curl into a concave shape corresponding to the inner side of the curl, and the second surface S2 given the concave shape by the winding curl into a convex shape corresponding to the outer side of the curl, by nipping the paper sheet S in collaboration with the transport roller 28*a*. Consequently, the paper sheet S from which the winding curl has been removed because of being bent between the pair of transport rollers 28 is transported to the downstream side in the transport direction.

Figure 7:
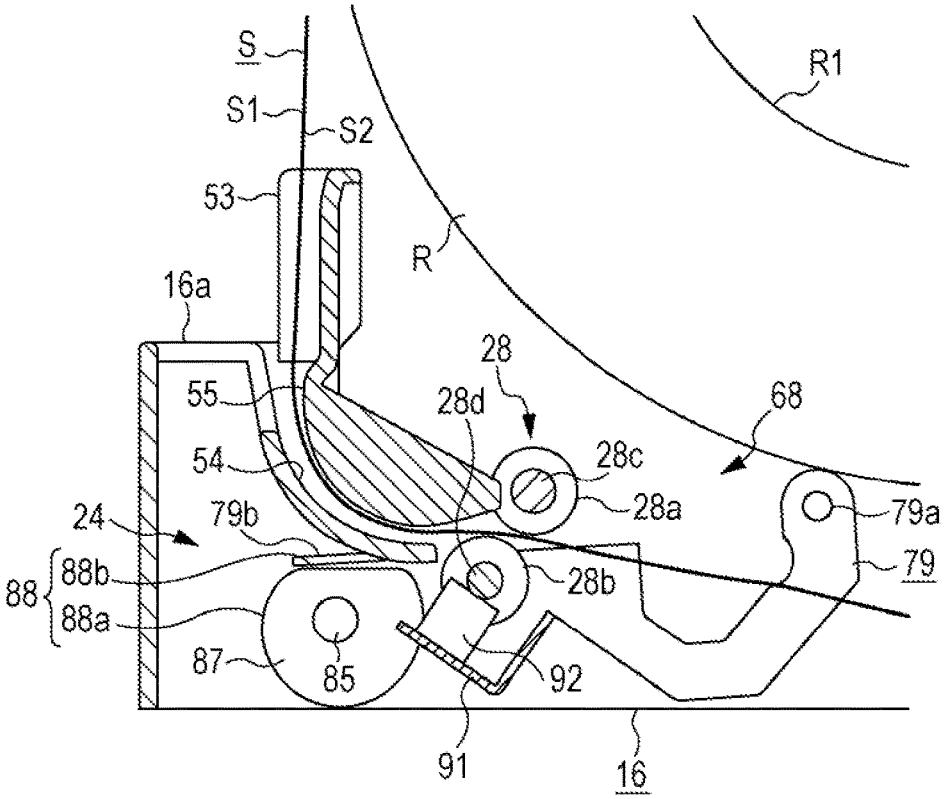
FIG. 7 is a cross-sectional view showing a pair of transport rollers disengaged from a paper sheet.

Referring now to FIGS. 5 and 7, the function of the transport device 24 to transport the paper sheet S backward opposite to the transport direction will be described hereunder.

To transport the paper sheet S backward opposite to the transport direction, the drive source 26 rotates in the second direction opposite to the first direction, so that gears 71 to 77 constituting the motor pinion 60, the first composite gear 61, the second composite gear 62, and the transmission mechanism 65 are made to rotate in the direction opposite to the arrows in FIG. 5. Further, the flange portion 23 is made to rotate clockwise in FIG. 5 by the driving force of the drive source 26. Accordingly, the transport rollers 28*a*, 29*a* are made to rotate in the second direction (clockwise in FIG. 5) opposite to the first direction, so as to transport the paper sheet S backward. The paper sheet S transported backward by the transport rollers 28*a*, 29*a* is then wound back on the roll body R.

Further, with the rotation of the seventh gear 77, the spur gears 82 to 84 constituting the gear row 78 and the rotary shaft 85 are made to rotate in the direction opposite to the arrows in FIG. 5. In addition, the rotating cam 87 is made to rotate counterclockwise in FIG. 5, so that the engaging plate 79*b* is brought into contact with the flat cam surface 88*b* instead of with the curved cam surface 88*a*. Then the pivotal lever 79 is made to pivot counterclockwise in FIG. 5 by the biasing force of the tensile sprint 90, so that the pressing member 91 is displaced to the position shown in FIG. 7.

As a result, as shown in FIG. 7, the slave roller 28*b* is displaced to the retracted position spaced from the engaging position. The paper sheet S is thus released from the nipped state between the pair of transport rollers 28 when being transported backward, which allows the paper sheet S to be wound back on the roll body R without disturbing the rotation of the roll body R.

As described above, the transport roller 28*a* serves to transport the paper sheet S in the transport direction by rotating in the first direction, and to transport the paper sheet S backward to the medium carrying unit 22 by rotating in the second direction. On the other hand, the slave roller 28*b* is set to the engaging position to nip the paper sheet S in collaboration with the transport roller 28*a* when the transport roller 28*a* rotates in the first direction, and displaced to the retracted position spaced from the engaging position when the transport roller 28*a* rotates in the second direction.

Figure 8:
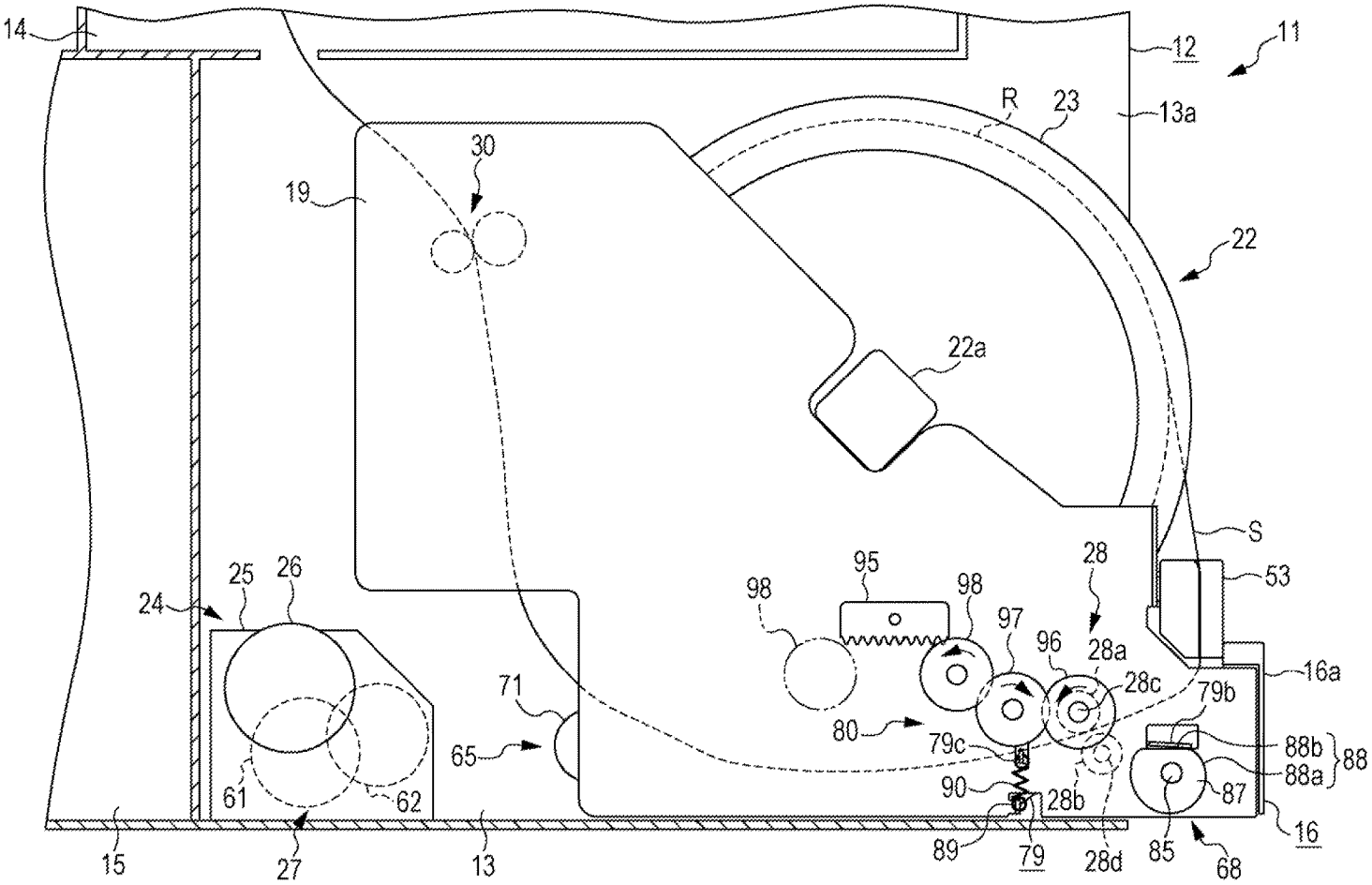
FIG. 8 is a cross-sectional view for explaining a function of a release mechanism.

Referring now to FIG. 8, the working of the release mechanism 80 will be described hereunder. FIG. 8 is a cross-sectional view of the retention frame 16 drawn out from the casing 12, seen from the left.

In the recording apparatus 11, the retention frame 16 may be drawn out from the casing 12, for example to remove a paper jam in case that the paper sheet S is jammed while being transported by the transport device 24 in the transport direction.

As shown in FIG. 8, when the pinion 98 supported by the retention frame 16 is displaced forward from the position indicated by dash-dot-dot lines in FIG. 8 because of the retention frame 16 being drawn out from the casing 12, the pinion 98 is meshed with the rack 95 provided inside the casing 12. In addition, with the forward movement of the retention frame 16, the pinion 98, the transmission gear 97 and the gear 96 are made to rotate in the release direction indicated by arrows in FIG. 8. Then the drive shaft 28*c* supporting the gear 96 is made to rotate in the second direction (counterclockwise in FIG. 8), so that the moving mechanism 68 displaces the movable shaft 28*d* away from the drive shaft 28*c*.

Accordingly, the slave roller 28*b* is displaced from the engaging position to the retracted position. Thus, the pair of transport rollers 28 release the paper sheet S from the nipped state when the pinion 98 meshed with the rack 95 is made to rotate because of the retention frame 16 being drawn out from the casing 12.

Here, when the retention frame 16 is drawn out all the way from the casing 12, the first gear 71 is separated from the second composite gear 62 and hence the transmission mechanism 65 is disengaged from the drive source 26. As a result, the transport roller 28*a* becomes freely rotatable and hence the drive shaft 28*c* is made to freely rotate by the rotation of the pinion 98. In addition, upon pulling the paper sheet S jammed in the retention frame 16, the transport roller 28*a* and the slave roller 28*b* are made to rotate following the movement of the paper sheet S, and thus the paper sheet S can be easily removed.

After the maintenance work for the transport route such as removing the jammed paper sheet S is finished, the retention frame 16 is set back inside the casing 12. At this point, the pinion 98 meshed with the rack 95 is made to rotate opposite to the release direction because of the backward movement of the retention frame 16 into the casing 12, and the drive shaft 28*c* is made to rotate in the first direction because of the rotation of the pinion 98, so that the moving mechanism 68 displaces the movable shaft 28*d* toward the drive shaft 28*c*. Accordingly, the slave roller 28*b* is displaced from the retracted position to the engaging position. As a result, the paper sheet S is nipped between the pair of transport rollers 28 when the drive source 26 is activated next, and therefore the transport of the paper sheet S can be quickly started.

When the retention frame 16 is entirely set back into the casing 12, the pinion 9 returns to the position indicated by dash-dot-dot lines in FIG. 8 thus being separated from the rack 95. Accordingly, the retention frame 16 is kept from moving in engagement with the rack 95 despite the drive shaft 28*c* and the pinion 98 being made to rotate by the driving force of the drive source 26 when the transport device 24 transports the paper sheet S.

The foregoing embodiment provides the following advantageous effects.

Since the paper sheet S is wound such that the second surface S2 constitutes the inner circumferential surface R1, the paper sheet S wound off from the roll body R is curled by the winding such that the second surface S2 is oriented to the inner side of the curl. Then the route defining portion 55 having the curved shape guides the paper sheet S such that the second surface remains oriented to the inner side of the curl. However, the slave roller 28*b* deforms the second surface S2 of the paper sheet S so as to be oriented to the outer side of the curl by nipping the paper sheet S in collaboration with the transport roller 28*a*, thereby correcting the winding curl of the paper sheet S. Further, since the route defining portion 55 is curved along the winding curl of the paper sheet S, fluctuation of the position to support the paper sheet S can be suppressed. Therefore, the winding curl formed on the paper sheet S can be effectively corrected.

The transport roller 28*a* and the slave roller 28*b* correct the winding curl of the paper sheet S at the position upstream of the recording unit 35 in the transport direction. Therefore, the paper sheet S can be prevented from floating at the position corresponding to the recording unit 35.

The slave roller 28*b* corrects the winding curl of the paper sheet S at the position most upstream in the transport direction in the transport route provided from the medium carrying unit 22 toward the recording unit 35. Therefore, disturbance to the transport of the paper sheet S originating from the curl thereof can be prevented at a downstream position on the transport route.

Since the route defining portion 55 of the curved shape has a smaller curvature radius than the inner circumferential surface R1 of the roll body R, the winding curl of the paper sheet S can be surely corrected without incurring an increase in size of the apparatus.

Since the outer circumferential surface of the transport roller 28*a* has a smaller curvature radius than the inner circumferential surface R1 of the roll body R, the winding curl of the paper sheet S can be surely corrected without incurring an increase in size of the apparatus. In addition, since the slave roller 28*b* is in contact with the first surface S1 of the paper sheet S in the valley portion, the paper sheet S can be bent along the valley portion while being securely supported by the route defining portion 55 and the transport roller 28*a*. Further, fluctuation of the curvature or length of the portion of the paper sheet S to be bent can be suppressed by bending the paper sheet S along the valley portion. Further, the degree of correction with respect to the paper sheet S can be adjusted by changing the curvature of the transport roller 28*a* and the route defining portions 54, 55.

The transport roller 28*a* is made to rotate in the first direction when the slave roller 28*b* nips the paper sheet S in collaboration with the transport roller 28*a*. Such a configuration allows the winding curl of the paper sheet S to be corrected while transporting the paper sheet S. In contrast, since the slave roller 28*b* is displaced to the retracted position when the transport roller 28*a* is made to rotate in the second direction, the backward movement of the paper sheet S is prevented from being disturbed.

Since the slave roller 28*b* is displaced by the driving force of the drive source 26 utilized for rotating the transport roller 28*a*, there is no need to separately provide a drive source for moving the slave roller 28*b*. Further, in the case where the pressing force of the slave roller 28*b* set to the engaging position applied against the transport roller 28*a* exceeds the predetermined threshold, the restriction mechanism 86 restricts the transmission of the driving force to the moving mechanism 68. Such an arrangement prevents an excessive increase of the nip pressure of the pair of transport rollers 28 against the paper sheet S. Therefore, the winding curl of the paper sheet S can be corrected without disturbing the transport of the paper sheet S.

The route defining portion 55 is a fixed component. Therefore, the structure can be simplified compared with the case of forming a curved transport route by using a rotating member such as a roller.

The pair of transport rollers 28 release the paper sheet S from the nipped state when the retention frame 16 is drawn out from the casing 12, for example when the paper sheet S is jammed on the transport route, and hence the paper sheet S can be easily removed. Such a configuration facilitates the maintenance work for the transport route in the vicinity of the pair of transport rollers 28.

Since the rack 95 and the release mechanism 80 are engaged with each other when the retention frame 16 is drawn out from the casing 12, there is no need to take an additional step to release the paper sheet S from the pair of transport rollers 28.

The transmission mechanism 65 is disengaged from the drive source 26 when the retention frame 16 is drawn out from the casing 12, and hence the transport roller 28*a* is set to freely rotate. Such a configuration reduces frictional resistance arising between the paper sheet S and the transport roller 28*a* when the paper sheet S is removed from the transport route.

The pair of transport rollers 28 serve to correct the winding curl of the paper sheet S. In addition, even when the paper sheet S is a continuous sheet formed in a roll body, the paper sheet S can be easily removed from the transport route because the pair of transport rollers 28 release the paper sheet S from the nipped state.

The rack and pinion mechanism composed of the rack 95 and the pinion 98 serves to release the paper sheet S from the nipped state between the pair of transport rollers 28.

The pair of transport rollers 28 release the paper sheet S from the nipped state when the movable shaft 28*d* is displaced away from the drive shaft 28*c* because of the retention frame 16 being drawn out from the casing 12. In contrast, the slave roller 28*b* is displaced to the position to nip the paper sheet S when the movable shaft 28*d* is displaced toward the drive shaft 28*c* because of the retention frame 16 being moved back into the casing 12. Such a configuration eliminates the need to take an additional step to displace the slave roller 28*b* after the retention frame 16 is set back in the casing 12 upon finishing the maintenance work of the transport route. Further, since the pinion 98 is disengaged from the rack 95 when the retention frame 16 is completely set back in the casing 12, the retention frame 16 is kept from moving despite the drive shaft 28*c* being made to rotate by the driving force of the drive source 26 to transport the paper sheet S.

The transmission mechanism 65 is provided on the side wall 18 of the retention frame 16, while the gear 96, the transmission gear 97, and the pinion 98 constituting the release mechanism 80 are provided on the side wall 19 of the retention frame 16 opposite the side wall 18. Such a configuration suppresses an increase in dimensions of the retention frame 16 constituting part of the apparatus.

The foregoing embodiment may be modified as under.

The retention frame 16 may be disabled from being drawn out from the casing 12.

The slave roller 28*b* may be constantly located at the engaging position without being displaced to the retracted position.

A rotating member such as a roller or a belt may be provided upstream of the pair of transport rollers 28 in the transport direction, so that the slave roller 28*b* nips the paper sheet S in a valley portion formed between the rotating member and the transport roller 28*a*.

The number of the pairs of transport rollers may be modified as desired.

The pair of transport rollers 28 may be composed of two transport rollers 28*a* both of which are driven to rotate by the drive source 26.

The curvature radius of the pair of transport rollers 28 and the route defining portion 54, 55 may be equal to that of the inner circumferential surface R1 of the roll body R. Alternatively, the curvature radius of the pair of transport rollers 28 and the route defining portion 54, 55 may be larger than that of the inner circumferential surface R1 of the roll body R.

The moving mechanism 68 may be configured so as to displace the slave roller 29*b*. In this case, the pair of transport rollers 29 release the paper sheet S from the nipped state when the paper sheet is transported backward or when the retention frame 16 is drawn out, which facilitates the maintenance work for the transport route in the deeper portion of the retention frame 16. In this case, further, the moving mechanism 68 may be configured to displace the slave roller 28*b* at the same time, and the slave roller 28*b* may be kept from being displaced to the retracted position.

In place of the torque limiter, a clutch mechanism may be employed as the restriction mechanism 86, so as to switch the transmission condition of the driving force when the slave roller 29*b* is set to the engaging position. Alternatively, the pressing member 91 may be formed of an elastically deformable material, so as to restrict the movement of the slave roller 29*b* with the elastic deformation of the pressing member 91.

The restriction mechanism 86 may be excluded.

The moving mechanism 68 may be driven to displace the slave roller 28*b* by driving force of another drive source than the drive source 26.

The drive source may be configured to generate the rotational force for example with a heat engine, instead of the motor.

The transmission mechanism 65 may be configured to transmit the driving force of the drive source by using an endless rotary belt or a piston, instead of the gear row.

The engaging portion to be engaged with the release mechanism 80 is not limited to the rack 95, but may be a projection or a recess formed in the casing 12 to be engaged with the pivotal lever 79, for displacing the slave roller 28*b* by the pivotal motion of the pivotal lever 79.

The transmission mechanism 65 and the release mechanism 80 may be located together on either of the side walls 18, 19. Alternatively, at least one of the transmission mechanism 65 and the release mechanism 80 may be provided on the rear wall or bottom face of the retention frame 16.

The retention frame 16 may be configured to support the drive source 26.

The medium may be, for example, a plastic film or a cloth employed by a printing machine, without limitation to the paper sheet.

The transport device 24 is broadly applicable to apparatuses in which a medium is transported, such as an apparatus that processes a medium and an apparatus for taking up or winding off a medium.

The recording apparatus is not limited to a serial printer having a carriage 46 that reciprocates in a printing region, but may be a full-line head printer including liquid ejecting units provided over the entire width of the printing region.

The recording apparatus is not limited to a liquid ejecting apparatus such as a printer that ejects a liquid for performing printing operation, but may be, for example, an electrophotographic laser printer that electrostatically applies micro particles such as a toner on a medium, a thermal transfer printer including a sublimation printer, or a dot-impact printer.

Recording apparatuses to which the foregoing embodiment is applicable include liquid ejecting apparatuses that eject or dispense other types of fluid than the ink, including a liquid containing, dispersed or mixed therein, another liquid or functional particles, a gel, and a solid substance that can be made to flow as a fluid so as to be ejected. Examples of the liquid ejecting apparatus include those that eject a liquid containing, dispersed or dissolved therein, an electrode material or a color material for manufacturing LCDs, electroluminescence displays, and field emission displays. The invention is further applicable to fluid ejecting apparatuses that eject a fluid such as a gel (for example, a physical gel), particle ejecting apparatuses that eject a solid in a particulate phase, for example a toner jet recording apparatus. The term "fluid" herein referred to encompasses liquids such as an inorganic solvent, an organic solvent, a solution, a liquid resin, a liquid metal (metallic melt), materials in a liquid phase, materials having fluidity, and particulate materials (including particles and powders), other than those solely composed of gas.

The entire disclosure of Japanese Patent Application No.: 2012-275006, filed Dec. 17, 2012 and 2012-275007, filed Dec. 17, 2012 are expressly incorporated by reference herein.

What is claimed is:

1. A transport device comprising:

a medium carrying unit on which a medium having a first surface and a second surface opposite the first surface is superposedly wound in a cylindrical shape so as to form a roll body comprising the medium, the second surface being oriented so as to form an inner circumferential surface in the roll body;

a route defining portion fixed in a curved shape so as to guide the medium such that the second surface is oriented to an inner side of the curve, the route defining portion including a curved portion and an extending portion that extends from the curved portion and that is upstream from the curved portion in a direction in which the medium is transported;

a second roller that nips the medium in collaboration with a first roller being located downstream of the entire route defining portion in a direction in which the medium is transported so as to deform the medium such that the second surface becomes oriented to an outer side of the curve, the second roller being located downstream of the route defining portion in the direction in which the medium is transported; and a plurality of pairs of transport rollers that transport the medium, wherein the first roller and the second roller are located at a most upstream position in the transport direction, among the plurality of pairs of transport rollers.

2. A recording apparatus comprising:

the transport device according to claim 1; and a recording unit that performs recording on the medium transported by the transport device, wherein the first roller and the second roller are located upstream of the recording unit in the transport direction.

3. The recording apparatus according to claim 2, wherein route defining portion has a smaller curvature radius than the inner circumferential surface of the roll body.

4. The recording apparatus according to claim 2, wherein the outer circumferential surface of the first roller has a smaller curvature radius than the inner circumferential surface of the roll body, and the second roller nips the medium in collaboration with the first roller, in contact with the first surface of the medium in a valley portion formed between the route defining portion and the first roller.

5. The recording apparatus according to claim 2, wherein the first roller serves as a transport roller to be made to (i) rotate in a first direction so as to transport the medium in the transport direction and (ii) rotate in a second direction opposite to the first direction so as to transport the medium back toward the medium carrying unit, and the second roller serves as a slave roller to be (i) set to an engaging position to nip the medium in collaboration with the first roller when the first roller is made to rotate in the first direction and (ii) displaced to a retracted position spaced from the engaging position when the first roller is made to rotate in the second direction.

6. The recording apparatus according to claim 5, further comprising:

a drive source that rotates the first roller;

a moving mechanism that displaces the second roller from the retracted position to the engaging position with the driving force of the drive source; and a restriction mechanism that restricts transmission of the driving force to the moving mechanism when pressing force of the second roller placed at the engaging position against the first roller exceeds a predetermined threshold.

7. A transport device comprising:

a medium guide member that forms part of a transport route of a medium;

a pair of transport rollers configured to rotate with the medium nipped therebetween to transport the medium along the transport route, wherein the pair of transport rollers are located at a most upstream position in the transport route of the medium, among a plurality of pairs of transport rollers; and a retention frame that supports the medium guide member and the pair of transport rollers, the retention frame including a curved surface that supports the medium, the curved surface being disposed opposite to the medium guide member, wherein the retention frame is installed in a casing, the retention frame being set to be drawn out therefrom to load the print medium, wherein the medium guide member and the pair of transport rollers are drawn out when the retention frame is drawn out, and the pair of transport rollers release the medium from the nipped state when the retention frame is drawn out from the casing.

8. The transport device according to claim 7, further comprising:

an engaging portion located inside the casing; and a release mechanism retained by the retention frame, wherein the pair of transport rollers release the medium when the release mechanism is engaged with the engaging portion because of the retention frame being drawn out from the casing.

9. The transport device according to claim 7, further comprising:

a drive source located inside the casing; and a transmission mechanism that transmits the driving force of the drive source to the pair of transport rollers, wherein the transmission mechanism is disengaged from the drive source when the retention frame is drawn out from the casing.

10. The transport device according to claim 7, wherein the retention frame rotatably supports a roll body formed by superposingly winding the medium in a cylindrical shape, and the pair of transport rollers bend the medium on the transport route so as to correct winding curl of the medium.

11. The transport device according to claim 7, further comprising:

a rack fixed to the casing; and a pinion supported by the retention frame, wherein the pair of transport rollers release the medium from the nipped state when the pinion meshed with the rack is made to rotate because of the retention frame being drawn out.

12. The transport device according to claim 7, further comprising:

a rack fixed to the casing;

a pinion supported by the retention frame;

a drive shaft to be made to rotate with driving force of a drive source;

a movable shaft set to relatively move with respect to the drive shaft; and a moving mechanism that relatively moves the movable shaft with respect to the drive shaft when the drive shaft is made to rotate, wherein the pair of transport rollers include a first roller supported by the drive shaft so as to rotate interlocked therewith and a second roller rotatably supported by the movable shaft, the drive shaft is made to rotate in a first direction by rotation of the pinion so as to cause the moving mechanism to displace the movable shaft toward the drive shaft, the pinion being meshed with the rack so as to rotate when the retention frame is moved back into the casing, the drive shaft is made to rotate in a second direction by rotation of the pinion so as to cause the moving mechanism to displace the movable shaft away from the drive shaft, the pinion being meshed with the rack so as to rotate when the retention frame is drawn out from the casing, and the pinion is disengaged from the rack when the retention frame is completely set inside the casing.

* * * * *